US008712297B2

(12) United States Patent
Ohashi et al.

(10) Patent No.: US 8,712,297 B2
(45) Date of Patent: Apr. 29, 2014

(54) TRANSFER DEVICE AND IMAGE FORMING APPARATUS INCLUDING REGULATION MEMBER

(75) Inventors: Shiro Ohashi, Kanagawa (JP); Hiroshi Nishikawa, Kanagawa (JP); Hiroki Shiba, Kanagawa (JP); Shinya Kumagai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 271 days.

(21) Appl. No.: 13/271,716

(22) Filed: Oct. 12, 2011

(65) Prior Publication Data

US 2012/0251193 A1 Oct. 4, 2012

(30) Foreign Application Priority Data

Mar. 28, 2011 (JP) ..... 2011-071132

(51) Int. Cl.
*G03G 15/16* (2006.01)

(52) U.S. Cl.
USPC ..... 399/299

(58) Field of Classification Search
USPC ..... 399/299, 66, 302
See application file for complete search history.

(56) References Cited

U.S. PATENT DOCUMENTS

| | | | | |
|---|---|---|---|---|
| 7,904,010 | B2 * | 3/2011 | Meguro et al. | 399/299 |
| 8,010,004 | B2 * | 8/2011 | Tachiki et al. | 399/66 |
| 2005/0158085 | A1 * | 7/2005 | Murakami et al. | 399/299 |
| 2007/0166080 | A1 * | 7/2007 | Kwak | 399/299 |

FOREIGN PATENT DOCUMENTS

JP A-2008-151976 7/2008

* cited by examiner

*Primary Examiner* — Quana M Grainger
(74) *Attorney, Agent, or Firm* — Oliff PLC

(57) ABSTRACT

A transfer device includes an endless member caused to circulate by a driving unit, plural transfer members coming in contact with a rear surface of the endless member and transferring toner images on image holding members to the endless member, a support member movably supporting a specific transfer member of the transfer members located at a position which is more upstream in a circulation direction of the endless member than a contact position where a recording medium comes in contact with the endless member and which is closest to the contact position, a regulation member regulating the movement of the specific transfer member in a state where the specific transfer member is disposed at a position where the toner image formed on the corresponding image holding member is transferred to the endless member, and a first impelling member impelling the support member to the regulation member.

5 Claims, 14 Drawing Sheets

TRANSFER DEVICE AND IMAGE FORMING APPARATUS INCLUDING REGULATION MEMBER

CROSS-REFERENCE TO RELATED APPLICATIONS

This application is based on and claims priority under 35 USC 119 from Japanese Patent Application No. 2011-071132 filed Mar. 28, 2011.

BACKGROUND

Technical Field

The present invention relates to a transfer device and an image forming apparatus.

SUMMARY

According to an aspect of the invention, there is provided a transfer device including: an endless type endless member that is caused to circulate by a driving unit; plural transfer members that come in contact with a rear surface of the endless member, that is disposed opposite to plural image holding members holding toner images of different colors with the endless member interposed therebetween, respectively, and that transfers the toner images respectively formed on the image holding members to the surface of the endless member; a support member that movably supports the specific transfer member of the plural transfer members which is located at a position which is more upstream in a circulation direction of the endless member than a contact position where a recording medium to which the toner images formed on the endless member are transferred by the transfer members comes in contact with the endless member and which is closest to the contact position; a regulation member that regulates movement of the specific transfer member in a state where the specific transfer member is disposed at a position where the toner image formed on the corresponding image holding member is transferred to the endless member; and a first impelling member that impels the support member to the regulation member.

BRIEF DESCRIPTION OF THE DRAWINGS

Exemplary embodiments of the present invention will be described in detail based on the following figures, wherein.

DETAILED DESCRIPTION

Figure 1:
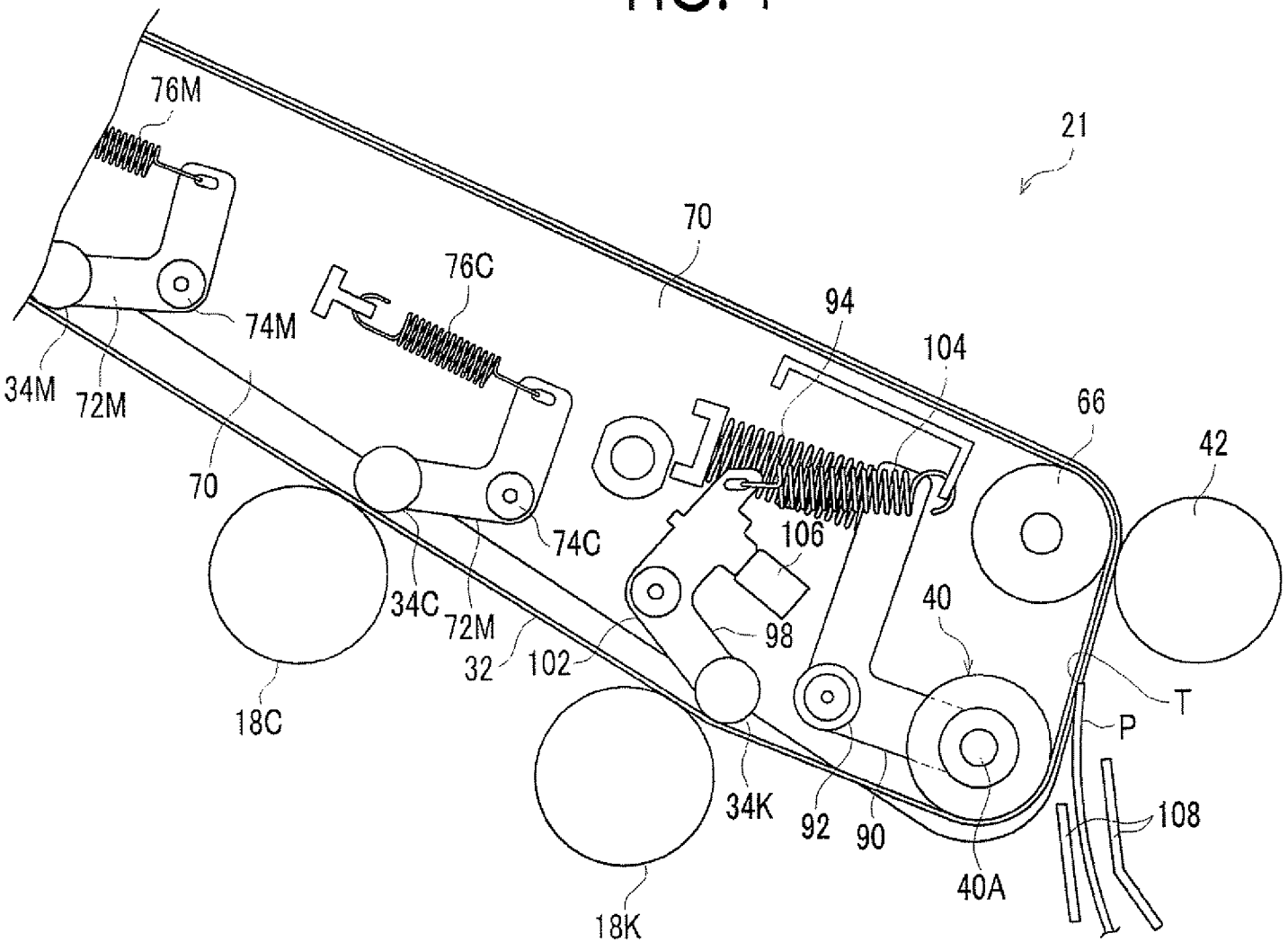
FIG. 1 is a side view illustrating a primary transfer unit according to an exemplary embodiment of the invention.
Figure 2:
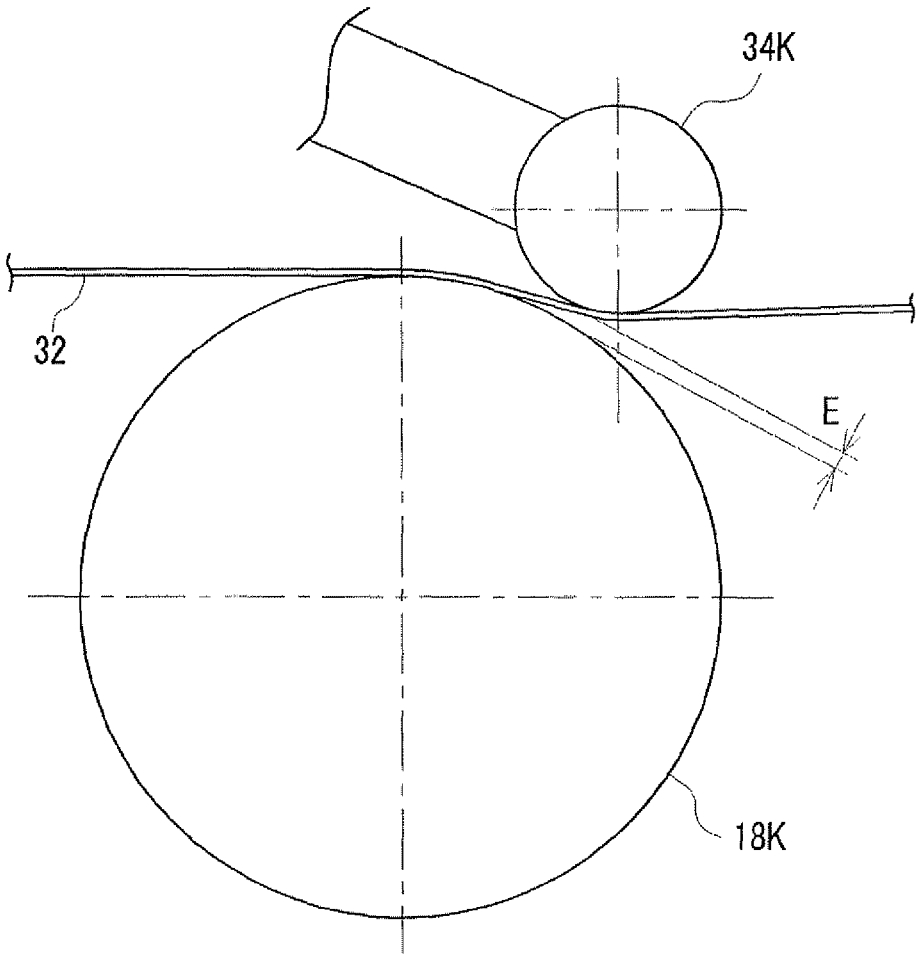
FIG. 2 is a side view illustrating a black primary transfer roll used in the primary transfer unit according to the exemplary embodiment of the invention.

A transfer device and an image forming apparatus according to an exemplary embodiment of the invention will be described below with reference to FIGS. 1 to 14. The arrow UP shown in the drawings indicates the upside in the vertical direction.

Overall Configuration

Figure 14:
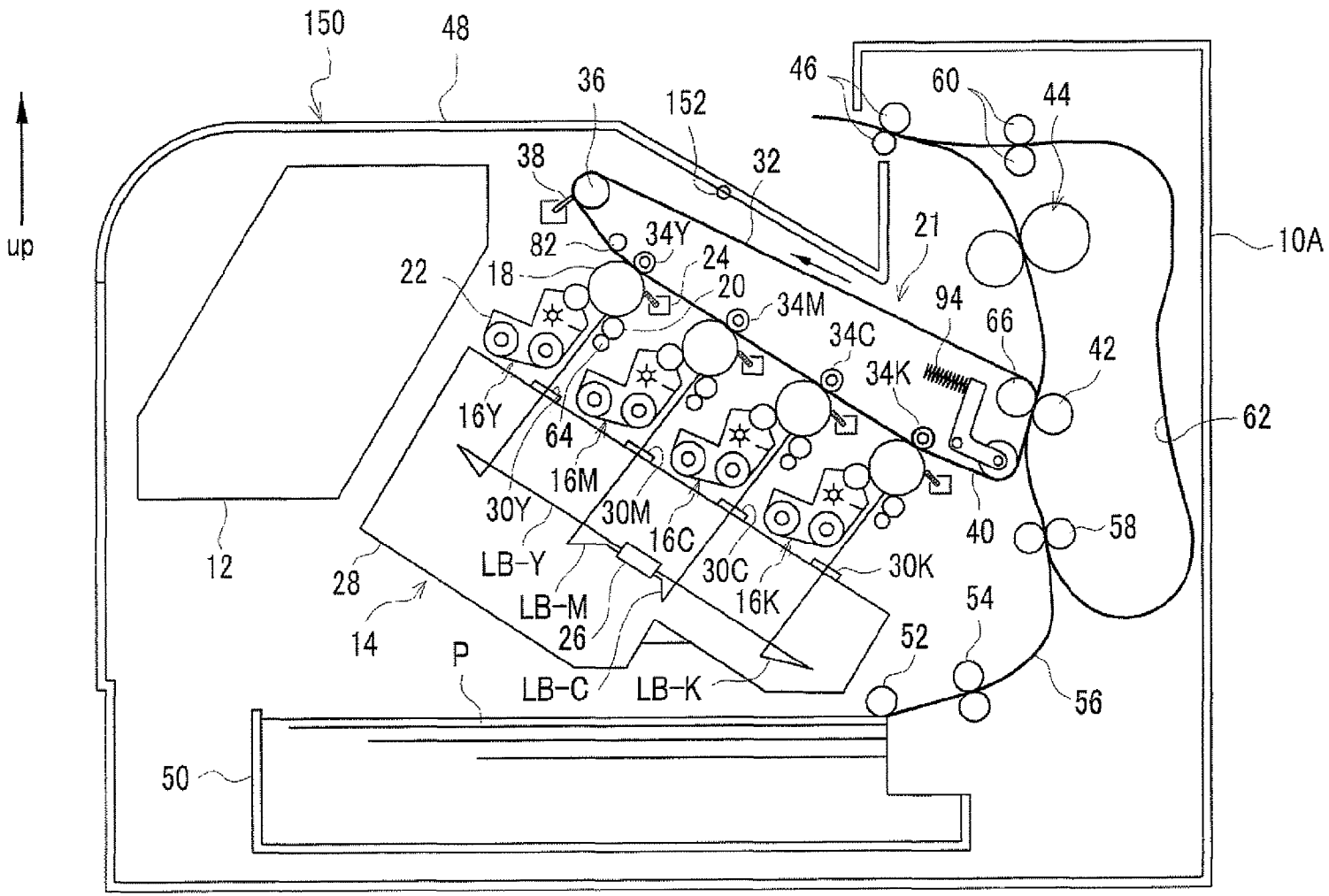
FIG. 14 is a diagram schematically illustrating the configuration of the image forming apparatus according to the exemplary embodiment of the invention.

As shown in FIG. 14, an image processing unit 12 that processes an image on the basis of input image data is disposed in an apparatus body 10A of an image forming apparatus 10.

The image processing unit 12 processes the input image data into four color gray-scale data of yellow (Y), magenta (M), cyan (C), and black (K). An exposing device 14 receiving the processed gray-scale data and performing image exposure using a laser beam LB is disposed at the center of the apparatus body 10A.

Above the exposing device 14, four image forming units 16Y, 16M, 16C, and 16K of yellow (Y), magenta (M), cyan (C), and black (K) are arranged at intervals in a direction oblique about the horizontal direction. When Y, M, C, and K need not be distinguished from each other, Y, M, C, and K may not be added.

The four image forming units 16Y, 16M, 16C, and 16K have the same configuration and each includes a cylindrical image holding member 18 that is rotationally driven at a predetermined speed, a charging member 20 for primary charging that charges the outer peripheral surface of the image holding member 18, a developing member 22 that develops an electrostatic latent image formed on the outer peripheral surface of the image holding member 18 charged by the image exposure of the exposing device 14 with toner of a predetermined color to visualize the electrostatic latent image as a toner image, and a cleaning blade 24 cleaning the outer peripheral surface of the image holding member 18. A cleaning member 64 coming in contact with the charging member 20 to clean the outer peripheral surface of the charging member 20 is disposed below the charging member 20.

Four semiconductor lasers not shown corresponding to the four image forming units 16Y, 16M, 16C, and 16K are disposed in the exposing device 14. Laser beams LB-Y, LB-M, LB-C, and LB-K are emitted from the semiconductor lasers on the basis of the gray-scale data.

The laser beams LB-Y, LB-M, LB-C, and LB-K emitted from the semiconductor lasers are applied to a polygon mirror 26 which is a rotational multi-faced mirror via a cylindrical lens not shown and are deflected and scanned by the polygon mirror 26. The laser beams LB-Y, LB-M, LB-C, and LB-K deflected and scanned by the polygon mirror 26 are applied to exposure points on the image holding members 18 via a focusing lens and plural mirrors not shown obliquely from the downside.

Since the image holding members 18 are scanned and exposed with images from the downside by the exposing device 14, toner or the like may be dropped on the exposing device 14 from the developing members 22 of the four image forming units 16Y, 16M, 16C, and 16K located above. Accordingly, the exposing device 14 is closely surrounded by a parallelepiped frame 28. Windows 30Y, 30M, 30C, and 30K formed of transparent glass to transmit the four laser beams LB-Y, LB-M, LB-C, and LB-K to the image holding members 18 of the image forming units 16Y, 16M, 16C, and 16K are disposed in the upper part of the frame 28.

On the other hand, a primary transfer unit 21 as an example of the transfer device is disposed above the image forming units 16Y, 16M, 16C, and 16K. The primary transfer unit 21 includes an intermediate transfer belt 32 as an example of the endless-type endless member, a driving roll 36 having the intermediate transfer belt 32 wound thereon and being rotationally driven to cause the intermediate transfer belt 32 to circulate in the arrow direction, a tension roll 40 as an example of the tension member having the intermediate transfer belt 32 wound thereon and giving a tension to the intermediate transfer belt 32, a driven roll 66 being disposed above the tension roll 40 and rotating to follow the circulation of the intermediate transfer belt 32, and primary transfer rolls 34Y, 34M, 34C, and 34K as an example of the transfer member disposed opposite to the image holding members 18Y, 18M, 18C, and 18K with the intermediate transfer belt 32 interposed therebetween.

The color toner images of yellow (Y), magenta (M), cyan (C), and black (K) sequentially formed on the image holding members 18 of the image forming units 16Y, 16M, 16C, and 16K of yellow (Y), magenta (M), cyan (C), and black (K) are multiply transferred to the intermediate transfer belt 32 by the four primary transfer rolls 34Y, 34M, 34C, and 34K.

A cleaning blade 38 cleaning the outer peripheral surface of the intermediate transfer belt 32 is disposed opposite to the driving roll 36 with the intermediate transfer belt 32 interposed therebetween. Details of the primary transfer unit 21 will be described later.

A secondary transfer roll 42 is disposed opposite to the driven roll 66 with the intermediate transfer belt 32 interposed therebetween. The color toner images of yellow (Y), magenta (M), cyan (C), and black (K) multiply transferred to the intermediate transfer belt 32 are transported by the intermediate transfer belt 32 and are secondarily transferred to a sheet member P as an example of the recording medium transported along a sheet transporting path 56 between the driven roll 66 and the secondary transfer roll 42.

A fixing device 44 fixing the toner images transferred to the sheet member P to the sheet member P by the use of heat and pressure is disposed more downstream in a sheet member P transporting direction (hereinafter, simply referred to as downstream) than the secondary transfer roll 42.

A discharge roll 46 discharging the sheet member P having the toner images fixed thereto to a discharge section 48 disposed on the apparatus body 10A of the image forming apparatus 10 is disposed more downstream than the fixing device 44.

On the other hand, a sheet tray 50 on which sheet members P are stacked is disposed in the lower part of the apparatus body 10A of the image forming apparatus 10. A pickup roll 52 picking up and sending the sheet members P stacked on the sheet tray 50 to the sheet transport path 56 is disposed therein and a separation roll 54 separating and transporting the sheet member P sheet by sheet is disposed more downstream than the pickup roll 52. A registration roll 58 timing the transport of a sheet member is disposed more downstream than the separation roll 54. Accordingly, the sheet member P fed from the sheet tray 50 is sent to a position (the secondary transfer position) at which the intermediate transfer belt 32 and the secondary transfer roll 42 come in contact with each other by the rotating registration roll 58 at a predetermined time.

A transport roll 60 transporting the sheet member P having a toner image fixed to one surface thereof by the fixing device 44 to a double-side transporting path 62 without discharging the sheet member to the discharge section 48 by the use of the discharge roll 46 is disposed close to the discharge roll 46. Accordingly, the sheet member P transported along the double-side transporting path 62 is re-transported to the registration roll 58 in the inverted state, toner images are transferred and fixed to the rear surface of the sheet member P, and the resultant sheet member is discharged to the discharge section 48.

According to this configuration, an image is formed on a sheet member P as follows.

First, color gray-scale data are sequentially output to the exposing device 14 from the image processing unit 12, and the outer peripheral surfaces of the image holding members 18 charged by the charging members 20 are scanned and exposed with the laser beams LB-Y, LB-M, LB-C, and LB-K emitted from the exposing device 14 on the basis of the gray-scale data, whereby electrostatic latent images are formed on the outer peripheral surfaces of the image holding members 18. The electrostatic latent images formed on the image holding members 18 are visualized as color toner images of yellow (Y), magenta (M), cyan (C), and black (K) by the developing members 22Y, 22M, 22C, and 22K.

The toner images of yellow (Y), magenta (M), cyan (C), and black (K) formed on the image holding members 18 are multiply transferred to the circulating intermediate transfer belt 32 by the primary transfer rolls 34 of the primary transfer unit 21 disposed above the image forming units 16Y, 16M, 16C, and 16K.

The color toner images multiply transferred to the circulating intermediate transfer belt 32 are secondarily transferred to a sheet member P, which is transported along the sheet transporting path 56 at a predetermined time from the sheet tray 50 by the pickup roll 52, the separation roll 54, and the registration roll 58, by the secondary transfer roll 42.

The sheet member P having the toner images transferred thereto is transported to the fixing device 44. The toner images transferred to the sheet member P are fixed to the sheet member P by the fixing device 44 and the resultant sheet member P is discharged to the discharge section 48 disposed on the apparatus body 10A of the image forming apparatus 10 by the discharge roll 46.

When images are formed on both sides of the sheet member P, the sheet member p having the toner images fixed to one surface thereof by the fixing device 44 is transported along the double-side transporting path 62 with the transporting direction changed by the transport roll 60 without being discharged to the discharge section 48 by the discharge roll 46. When the sheet member P is transported along the double-side transporting path 62, the front and rear surfaces of the sheet member P are inverted and the sheet member P is transported to the registration roll 58 again. In this time, toner images are transferred and fixed to the rear surface of the sheet member P and the resultant sheet member is discharged to the discharge section 48 by the discharge roll 46.

Configuration of Primary Transfer Unit

The primary transfer unit 21 and the like will be described below.

Figure 3:
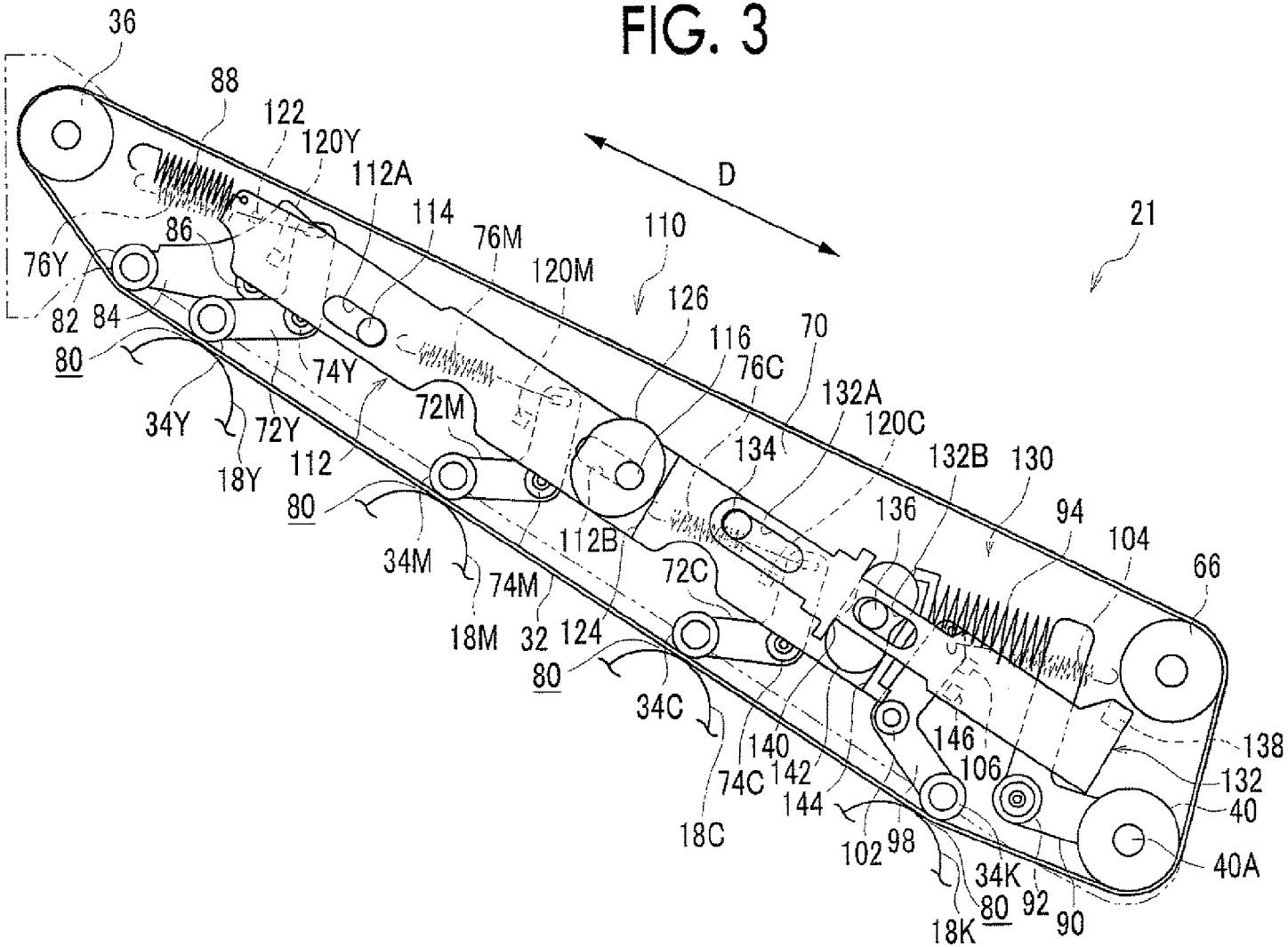
FIG. 3 is a side view illustrating the primary transfer unit according to the exemplary embodiment of the invention.
Figure 7:
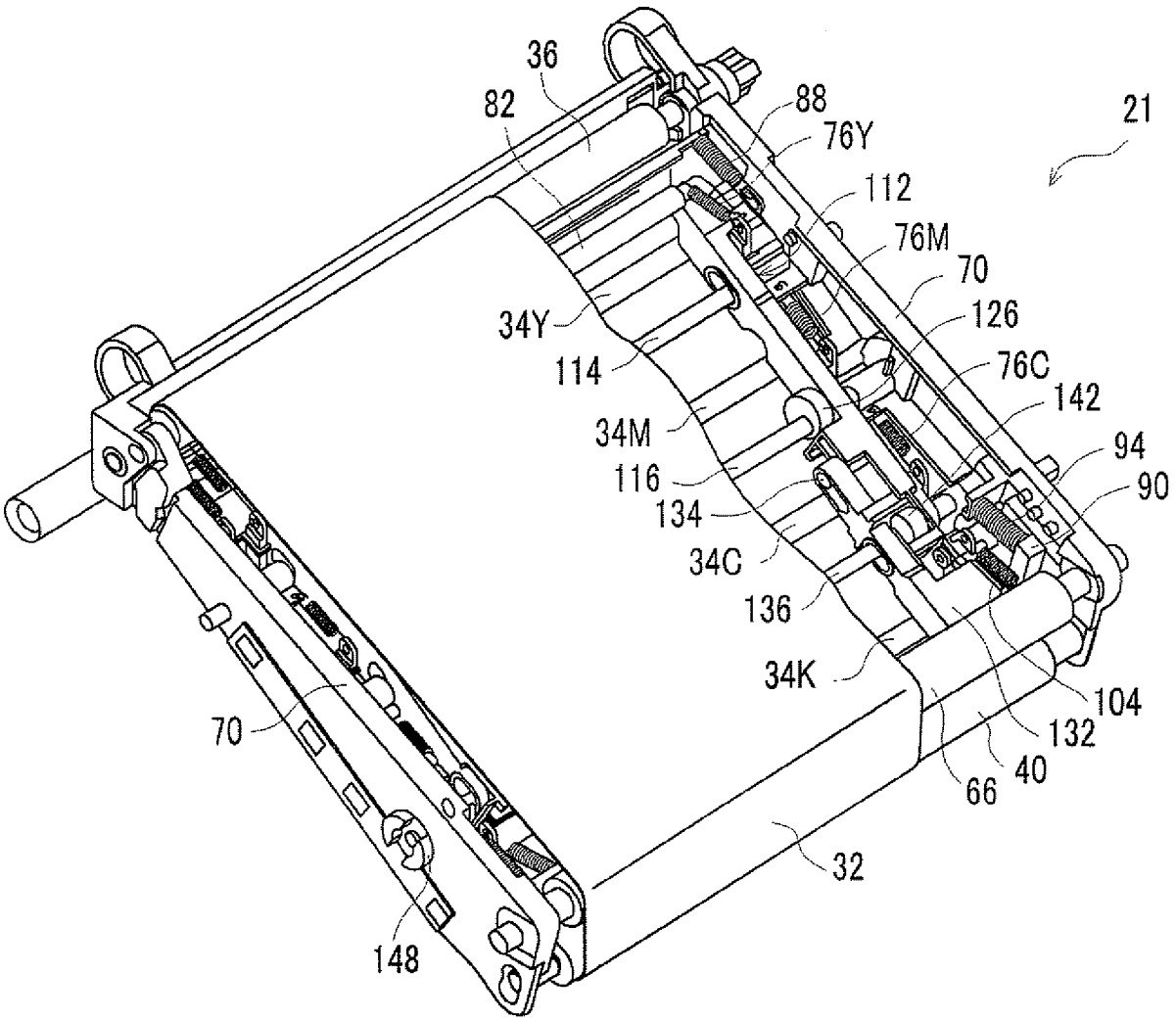
FIG. 7 is a perspective view illustrating the primary transfer unit according to the exemplary embodiment of the invention.
Figure 8:
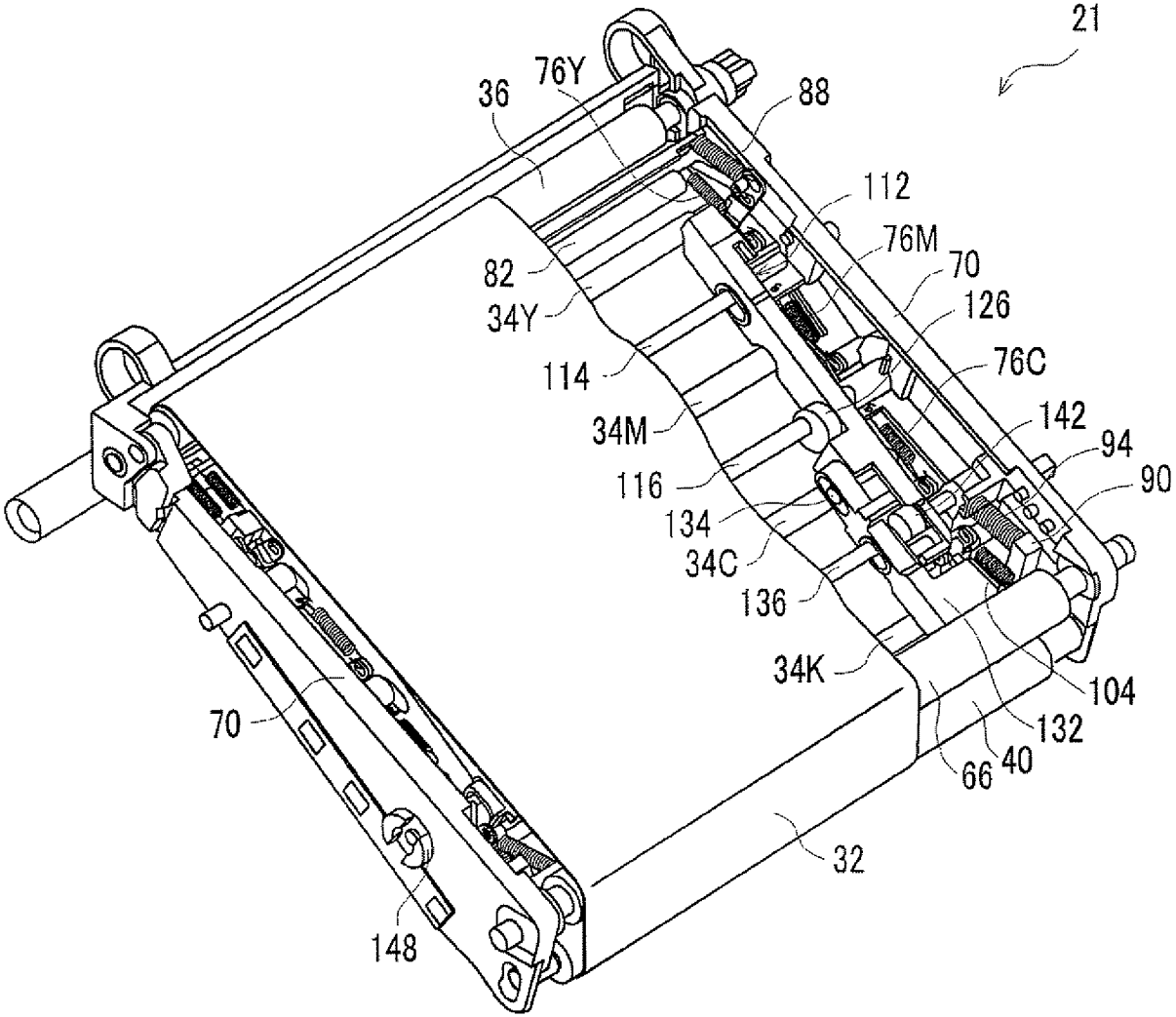
FIG. 8 is a perspective view illustrating the primary transfer unit according to the exemplary embodiment of the invention.
Figure 9:
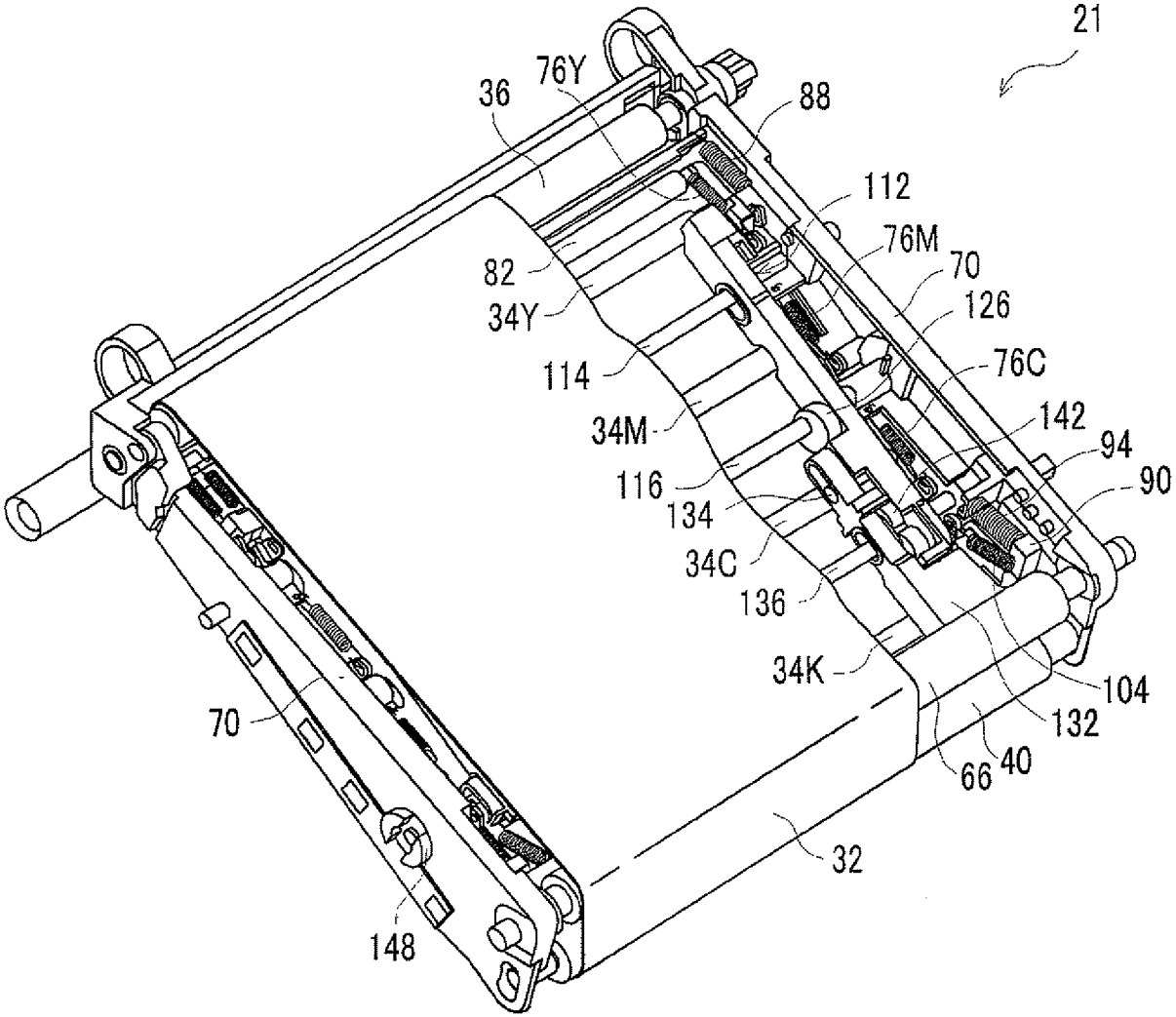
FIG. 9 is a perspective view illustrating the primary transfer unit according to the exemplary embodiment of the invention.
Figure 10:
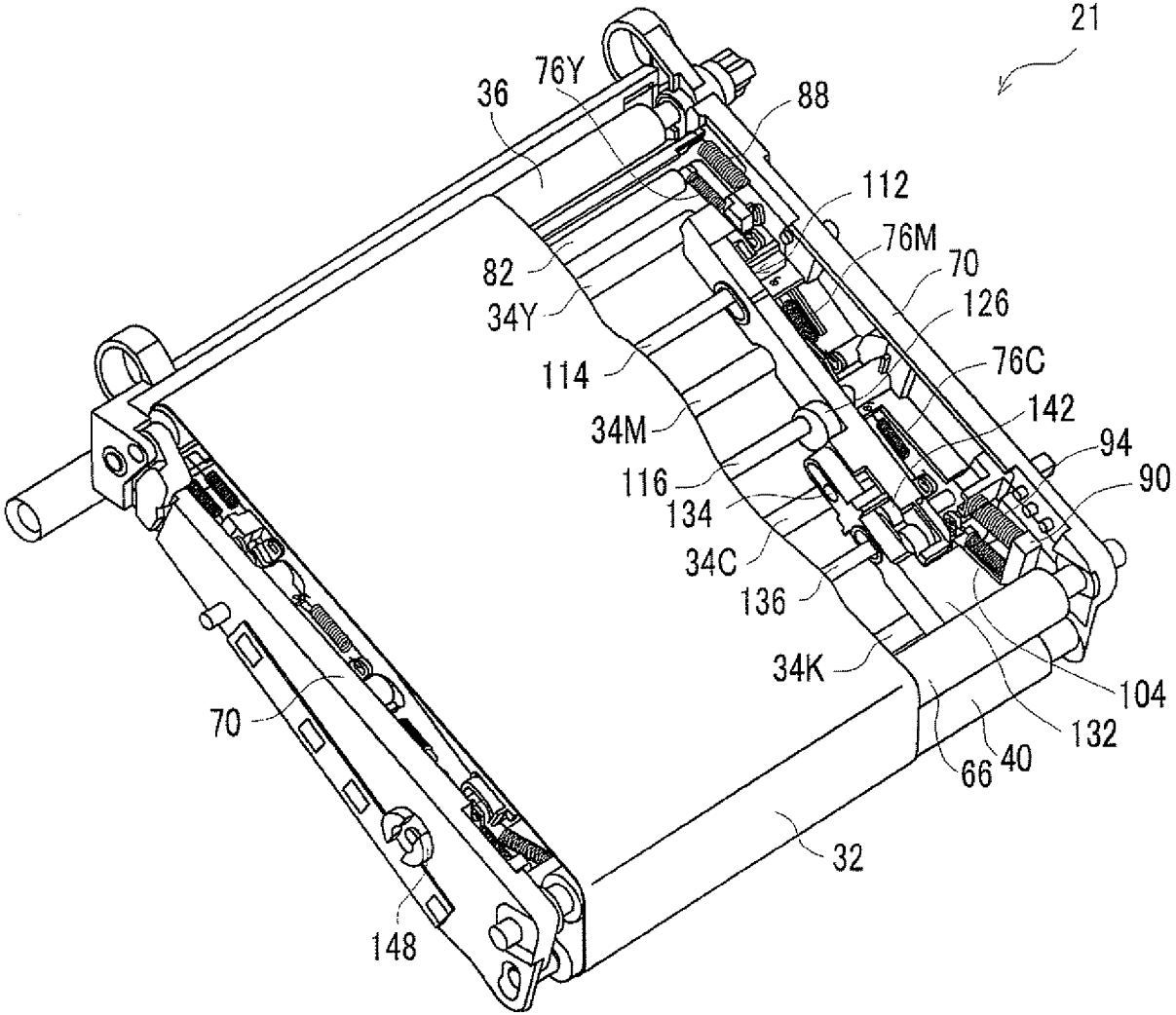
FIG. 10 is a perspective view illustrating the primary transfer unit according to the exemplary embodiment of the invention.

As shown in FIGS. 3 and 7, the color primary transfer rolls 34 transferring color toner images formed on the image holding members 18 to the intermediate transfer belt 32 are formed of metal (for example, stainless steel) and rotate to follow the circulation of the intermediate transfer belt 32.

When color toner images are multiply transferred to the intermediate transfer belt 32 (in a color print mode), the color primary transfer rolls 34 disposed in the primary transfer unit 21 press the intermediate transfer belt 32 against the image holding members 18. Accordingly, the toner images formed on the color image holding members 18 are transferred to the intermediate transfer belt 32.

Specifically, a pair of frame members 70 constituting the skeleton of the primary transfer unit 21 is disposed on both sides of the primary transfer unit 21 in the rotation shaft direction (hereinafter, simply referred to as shaft direction) of the primary transfer rolls 34.

Both ends of each of the primary transfer rolls 34Y, 34M, and 34C are rotatably disposed at tip portions of support members 72Y, 72M, and 72C having an inverted L shape in which the center is bent as seen in the shaft direction in FIG. 3. Rotation shafts 74Y, 74M, and 74C rotatably attaching the support members 72 to the frame members 70 and being directed in the shaft direction are disposed at the bent portions of the support members 72Y, 72M, and 72C.

Coil springs 76Y, 76M, and 76C as an example of the second impelling member impelling the primary transfer rolls 34Y, 34M, and 34C to the rear surface of the intermediate transfer belt 32 are disposed at the other tips of the support members 72Y, 72M, and 72C. Specifically, ends of the coil springs 76Y, 76M, and 76C are fixed to the other tips of the support members 72Y, 72M, and 72C and the other ends of the coil springs 76Y, 76M, and 76C are fixed to the frame members 70.

That is, the set positions of the primary transfer rolls 34Y, 34M, and 34C are determined so that the impelling forces of the coil springs 76Y, 76M, and 76C match the reaction force generated in the intermediate transfer belt 32 due to the impelling forces.

A regulation roll 82 as an example of the regulation member supporting the rear surface of the intermediate transfer belt 32 and regulating the circulating path of the intermediate transfer belt 32 in transfer parts 80 at which color toner images are transferred to the intermediate transfer belt 32 at the time of transferring the color toner images to the intermediate transfer belt 32 is disposed between the driving roll 36 and the primary transfer roll 34Y.

Both ends of the regulation roll 82 are rotatably attached to tip portions of a support member 84 having an inverted L shape in which the center is bent as seen in the shaft direction. A rotation shaft 86 rotatably attaching the support member 84 to the frame members 70 and being directed in the shaft direction is disposed in the bent portion of the support member 84.

A coil spring 88 as an example of the impelling member impelling the regulation roll 82 to the rear surface of the intermediate transfer belt 32 is disposed at the other tip portion of the support member 84. Specifically, an end of the coil spring 88 is fixed to the other tip portion of the support member 84 and the other end of the coil spring 88 is fixed to the frame members 70. The impelling force of the coil spring 88 is stronger than the impelling force of the coil springs 76. The primary transfer rolls 34Y, 34M, and 34C press the intermediate transfer belt 32 against the corresponding image holding members 18.

A protruding portion (not shown) coming in contact with the support member 84 to which the impelling force of the coil spring 88 is transmitted and determining the set position of the support member 84 is disposed in the frame members 70. In this way, since the support member 84 comes in contact with the protruding portion with the impelling force of the coil spring 88, it is possible to determine the set position of the regulation roll 82.

On the other hand, both ends of a rotation shaft 40A of the tension roll 40 giving a tension to the intermediate transfer belt 32 are rotatably supported by a tip portion of a support member 90 having an L shape in which the center is bent as seen in the shaft direction. A rotation shaft 92 rotatably attaching the support member 90 to the frame members 70 and being directed in the shaft direction is disposed in the bent portion of the support member 90. That is, the support member 90 rotates about the rotation shaft 92 and the tension roll 40 can move along a circular arc about the rotation shaft 92.

An end of a coil spring 94 as an example of the impelling member is fixed to the other tip portion (the tip portion extending to the upside) of the support member 90 and the other end of the coil spring 94 is fixed to the frame members 70. The coil spring 94 impels the other tip portion of the support member 90 so that the support member 90 rotates about the rotation shaft 92 and the tension roll 40 presses the rear surface (the inner peripheral surface) of the intermediate transfer belt 32. Accordingly, a tension in a predetermined range is given to the intermediate transfer belt 32.

The primary transfer roll 34K is disposed between the tension roll 40 and the primary transfer roll 34C. Both ends of the primary transfer roll 34K are rotatably attached to a tip portion of a support member 98 having an L shape in which the center is bent as seen in the shaft direction. A rotation shaft 102 rotatably attaching the support member 98 to the frame members 70 and being directed in the shaft direction is disposed in the bent portion of the support member 98.

A coil spring 104 as an example of the first impelling member impelling the primary transfer roll 34K to the rear surface of the intermediate transfer belt 32 is attached to the other tip portion of the support member 98. Specifically, an end of the coil spring 104 is fixed to the other tip portion of the support member 98 and the other end of the coil spring 104 is fixed to the frame members 70.

As shown in FIG. 1, a protruding portion 106 as an example of the contact member coming in contact with the other tip portion of the support member 98 to which the impelling force of the coil spring 104 is transmitted and determining the set position of the support member 98 is disposed in the frame members 70. That is, since the support member 98 is impelled to the protruding portion 106 with the impelling force of the coil spring 104, it is possible to determine the set position of the primary transfer roll 34K.

On the other hand, a pair of sheet guides 108 guiding a sheet member P, to which toner images formed on the intermediate transfer belt 32 are transferred, more upstream than the position (secondary transfer position) at which the intermediate transfer belt 32 and the secondary transfer roll 42 come in contact with each other is provided. The leading edge of the sheet member P guided by the sheet guides 108 comes in contact with the intermediate transfer belt 32 at a contact position T more upstream than the secondary transfer position.

That is, the set position of the primary transfer roll 34K disposed more upstream in the circulating direction of the intermediate transfer belt 32 than the contact position T and closest to the contact position T is determined by bringing the support member 98 supporting the primary transfer roll 34K into contact with the protruding portion 106.

Specifically, the primary transfer roll 34K of which the set position is determined is offset more downstream in the circulating direction of the intermediate transfer belt 32 than the image holding member 18K and a space (space E shown in FIG. 2) is disposed between the part of the intermediate transfer belt 32 pressed by the primary transfer roll 34K and the image holding member 18K.

The impelling force of the coil spring 104 is stronger than the impelling force of the coil springs 76. Specifically, the impelling force of the coil spring 104 is determined so that the expansion and contraction of the coil spring 104 due to the vibration of the intermediate transfer belt 32 is suppressed even when the sheet member P comes in contact with the intermediate transfer belt 32 at the contact position T to fluctuate the intermediate transfer belt 32. That is, even when the sheet member P comes in contact with the intermediate transfer belt 32 to cause the intermediate transfer belt 32 to vibrate, the vibration of the primary transfer roll 34K is suppressed.

Accordingly, the vibration of the intermediate transfer belt 32 generated at the contact position T by the contact of the sheet member P is suppressed from being transmitted to the contact parts (the transfer parts 80) between the color image holding members 18 and the intermediate transfer belt 32.

Between the regulation roll 82 of which the set position is determined as described above and the primary transfer roll 34K, the circulating path of the circulating intermediate transfer belt 32 is regulated to pass through a predetermined position. That is, the circulating path of the intermediate transfer belt 32 in the color transfer parts 80 is regulated by the regulation roll 82 and the primary transfer roll 34K.

On the other hand, a first switching mechanism 110 is provided which can switch the operation mode from a multicolor transfer mode in which toner images can be transferred to the surface of the intermediate transfer belt 32 by the color primary transfer rolls 34 by bringing the color primary transfer rolls 34 into contact with the rear surface of the intermediate transfer belt 32 to a mono-color transfer mode in which a toner image can be transferred to the surface of the intermediate transfer belt 32 by only the primary transfer roll 34K by causing the primary transfer rolls 34Y, 34M, and 34C to retreat from the rear surface of the intermediate transfer belt 32.

Figure 4:
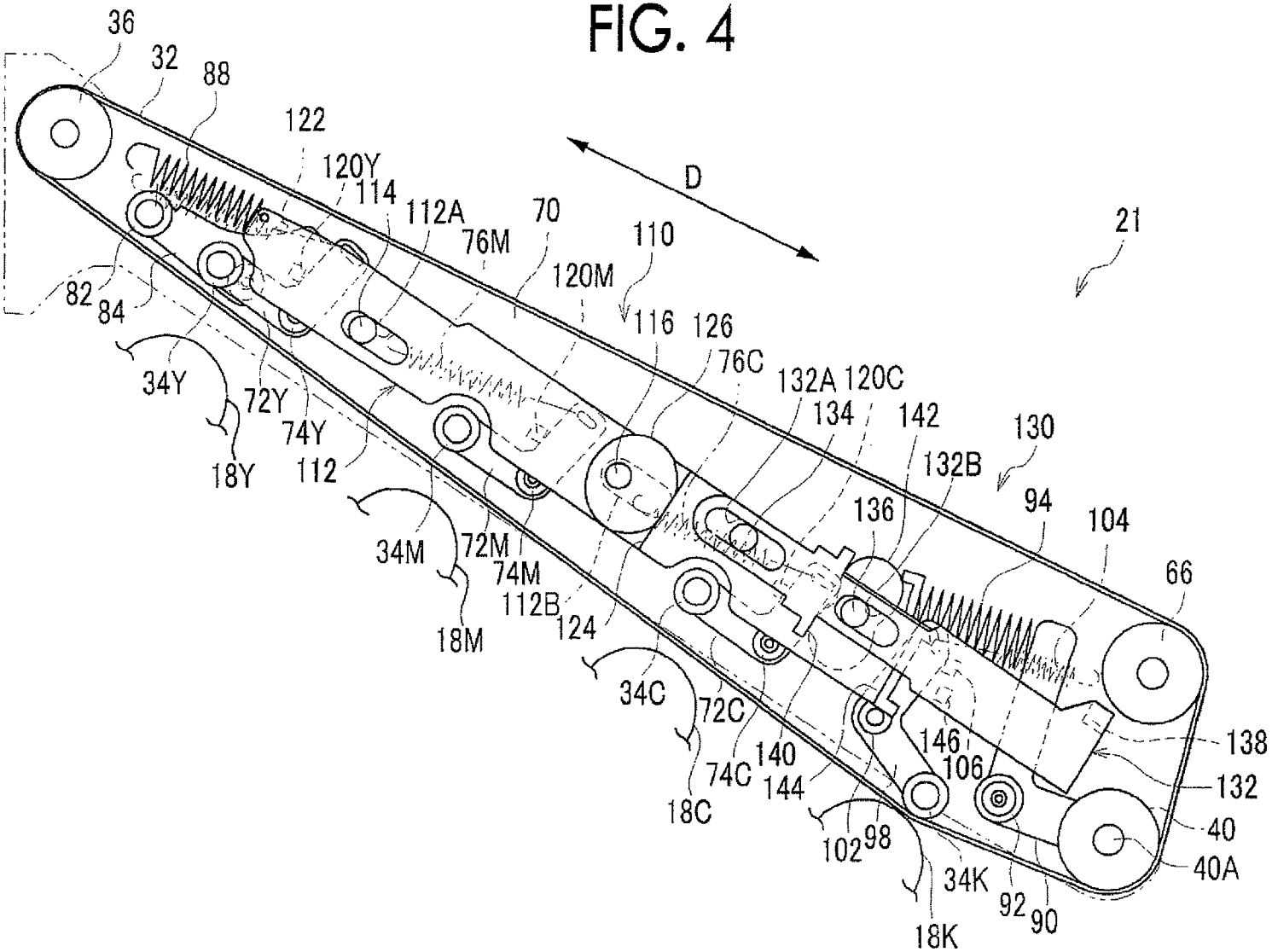
FIG. 4 is a side view illustrating the primary transfer unit according to the exemplary embodiment of the invention.

As shown in FIGS. 3 and 4, the first switching mechanism 110 includes a first moving member 112 that can move between a first position (see FIGS. 3 and 7) where the regulation roll 82 and the primary transfer rolls 34Y, 34M, and 34C come in contact with the rear surface of the intermediate transfer belt 32 and a second position (see FIGS. 4 and 8) where the regulation roll 82 and the primary transfer rolls 34Y, 34M, and 34C retreat from the intermediate transfer belt 32.

Specifically, the first moving member 112 is disposed in the inside (in which the primary transfer rolls 34 are disposed) in the shaft direction of the frame members 70 and has a plate shape extending in a first direction (the direction of arrow D shown in FIG. 3) in which the color primary transfer rolls 34 are arranged as seen in the shaft direction. A longitudinal hole 112A and a longitudinal hole 112B extending the first direction as seen in the shaft direction are formed in the first moving member 112, and the longitudinal hole 112A and the longitudinal hole 112B are arranged in a line in the first direction.

A cylindrical rod 114 passing through the longitudinal hole 112A and a cylindrical roll 116 passing through the longitudinal hole 112B are suspended between the pair of frame members 70. The rod 114 and the rod 116 can move in the longitudinal hole 112A and the longitudinal hole 112B, respectively. Accordingly, the first moving member 112 can reciprocate in the first direction.

The first moving member 112 includes a protruding portion 122 and protruding portions 120Y, 120M, and 120C that come in contact with the support member 84 and the support members 72 to cause the regulation roll 82 and the primary transfer rolls 34Y, 34M, and 34C to move from the first position (see FIG. 3) to the second position (see FIG. 4) when the first moving member 112 moves from one end to the other end.

A contact face 124 as an example of the first contact part facing the driving roll 36 in the first direction is formed in the first moving member 112. A cam member 126 as an example of the first switching member that comes in contact with the contact face 124 to cause the regulation roll 82 and the primary transfer rolls 34Y, 34M, and 34C to move from the first position (see FIG. 3) to the second position (see FIG. 4) through the use of the first moving member 112 is provided.

Specifically, as shown in FIG. 3, the cam member 126 is attached to the rod 116 and when the short-diameter portion of the cam member 126 faces the contact face 124, the pressing force is not transmitted to the support member 84 and the support members 72 via the protruding portion 122 and the protruding portions 120 and the regulation roll 82 and the primary transfer rolls 34Y, 34M, and 34C are located at the first position with the impelling forces of the coil spring 88 and the coil springs 76.

On the other hand, as shown in FIG. 4, when the rod 116 rotates and the long-diameter portion of the cam member 126 comes in contact with the contact face 124, the contact face 124 is pressed by the cam member 126 and the first moving member 112 moves to the tension roll 40 in the first direction. By the movement of the first moving member 112 in the first direction, the pressing force is transmitted to the support member 84 and the support members 72 via the protruding portion 122 and the protruding portions 120. The support member 84 and the support members 72 rotate about the rotation shaft 86 and the rotation shafts 74, respectively, and the regulation roll 82 and the primary transfer rolls 34Y, 34M, and 34C are located at the second position. The rod 116 rotates with a driving force transmitted by activating a drive source not shown and disposed outside the primary transfer unit 21 in response to an instruction from the control unit. When the pressing force from the first moving member 112 is released, the regulation roll 82 and the primary transfer rolls 34Y, 34M, and 34C moves from the second position to the first position with the impelling forces of the coil spring 88 and the coil springs 76, respectively.

On the contrary, a second switching mechanism 130 is provided which can change the operation mode from the mono-color transfer mode shown in FIG. 4 to a treat mode in which the first transfer roll 34K retreats from the rear surface of the intermediate transfer belt 32 and all the primary transfer rolls 34 retreat from the rear surface of the intermediate transfer belt 32 and can change the operation mode from the multicolor transfer mode shown in FIG. 3 to a retreat mode in which all the primary transfer rolls 34 retreat from the rear surface of the intermediate transfer belt 32.

As shown in FIGS. 3 and 4, the second switching mechanism 130 includes a second moving member 132 that can move between a third position where the primary transfer roll 34K comes in contact with the rear surface of the intermediate transfer belt 32 to support it and a fourth position (see FIGS. 5 and 6) where the primary transfer roll 34K retreats from the intermediate transfer belt 32.

Specifically, as shown in FIGS. 3 and 7, the second moving member 132 is disposed inside the first moving member 112 in the shaft direction so as to extend in the first direction as seen in the shaft direction. A longitudinal hole 132A and a longitudinal hole 132B extending in the first direction as seen in the shaft direction are formed in the second moving member 132, and the longitudinal hole 132A and the longitudinal hole 132B are arranged in a line in the first direction.

An embossed portion 134 passing through the longitudinal hole 132A is formed in the first moving member 112 so as to extend in the shaft direction. A cylindrical rod 136 passing through the longitudinal hole 132B is suspended between the pair of frame members 70. The embossed portion 134 and the rod 136 can move in the longitudinal hole 132A and the longitudinal hole 132B, respectively. Accordingly, the second moving member 132 can reciprocate in the first direction.

Figure 5:
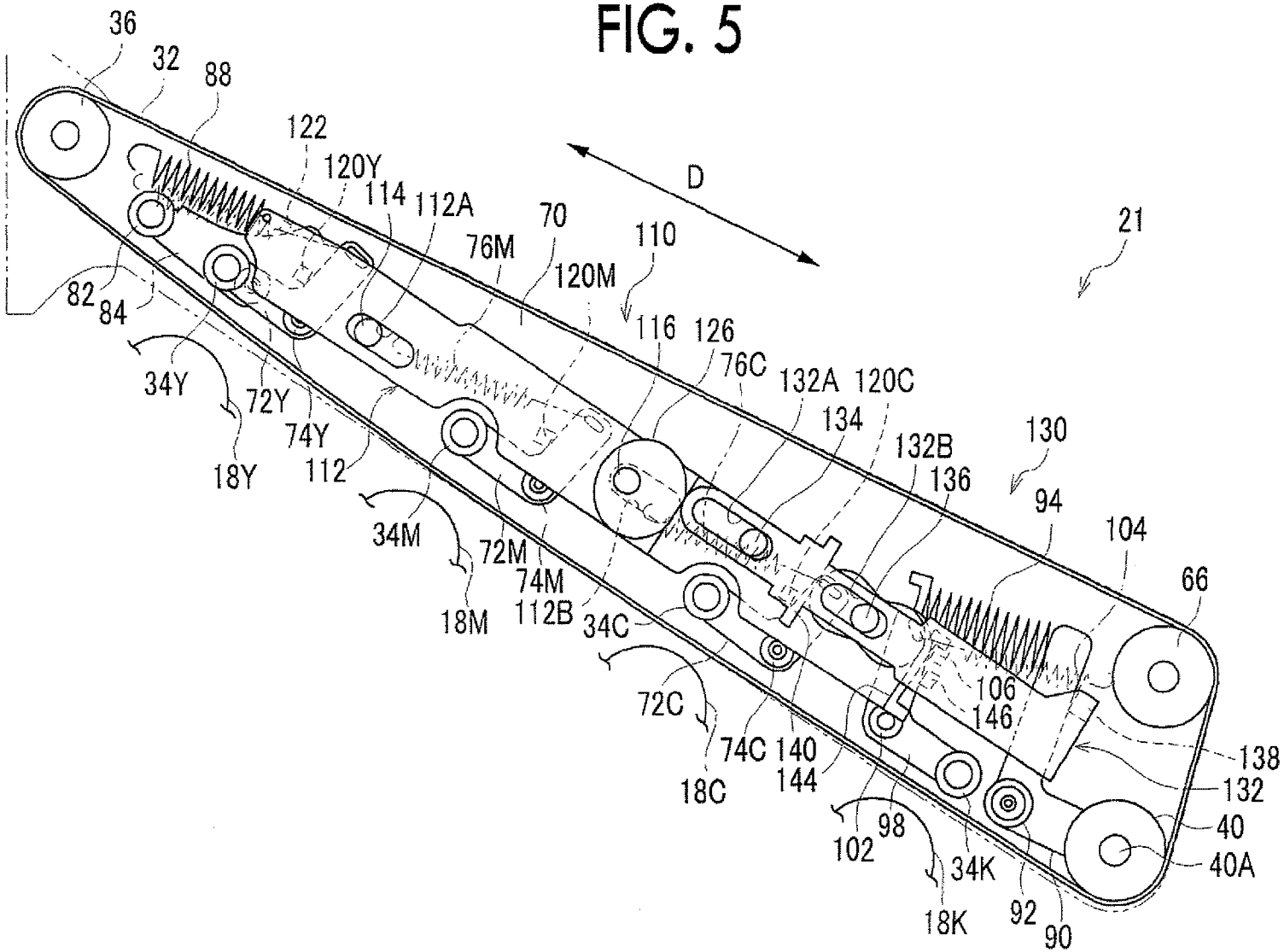
FIG. 5 is a side view illustrating the primary transfer unit according to the exemplary embodiment of the invention.

As shown in FIGS. 3 and 5, the second moving member 132 includes a protruding portion 146 that comes in contact with the support member 98 to cause the primary transfer roll 34K to move from the third position (see FIG. 3) to the fourth position (see FIGS. 5 and 9) when the second moving member 132 moves from one end to the other end.

Similarly, the second moving member 132 also includes a protruding portion 138 that comes in contact with the support member 90 and cause the support member 90 to rotates and to release the tension given to the intermediate transfer belt 32 by the tension roll 40 when the second moving member 132 moves from one end to the other end.

A contact face 140 as an example of the second contact part facing the tension roll 40 in the first direction is formed in the second moving member 132. A cam member 142 as an example of the second switching member is provided which comes in contact with the contact face 140 to cause the primary transfer roll 34K to move from the third position (see FIG. 3) to the fourth position (see FIG. 5) through the use of the second moving member 132.

Figure 11:
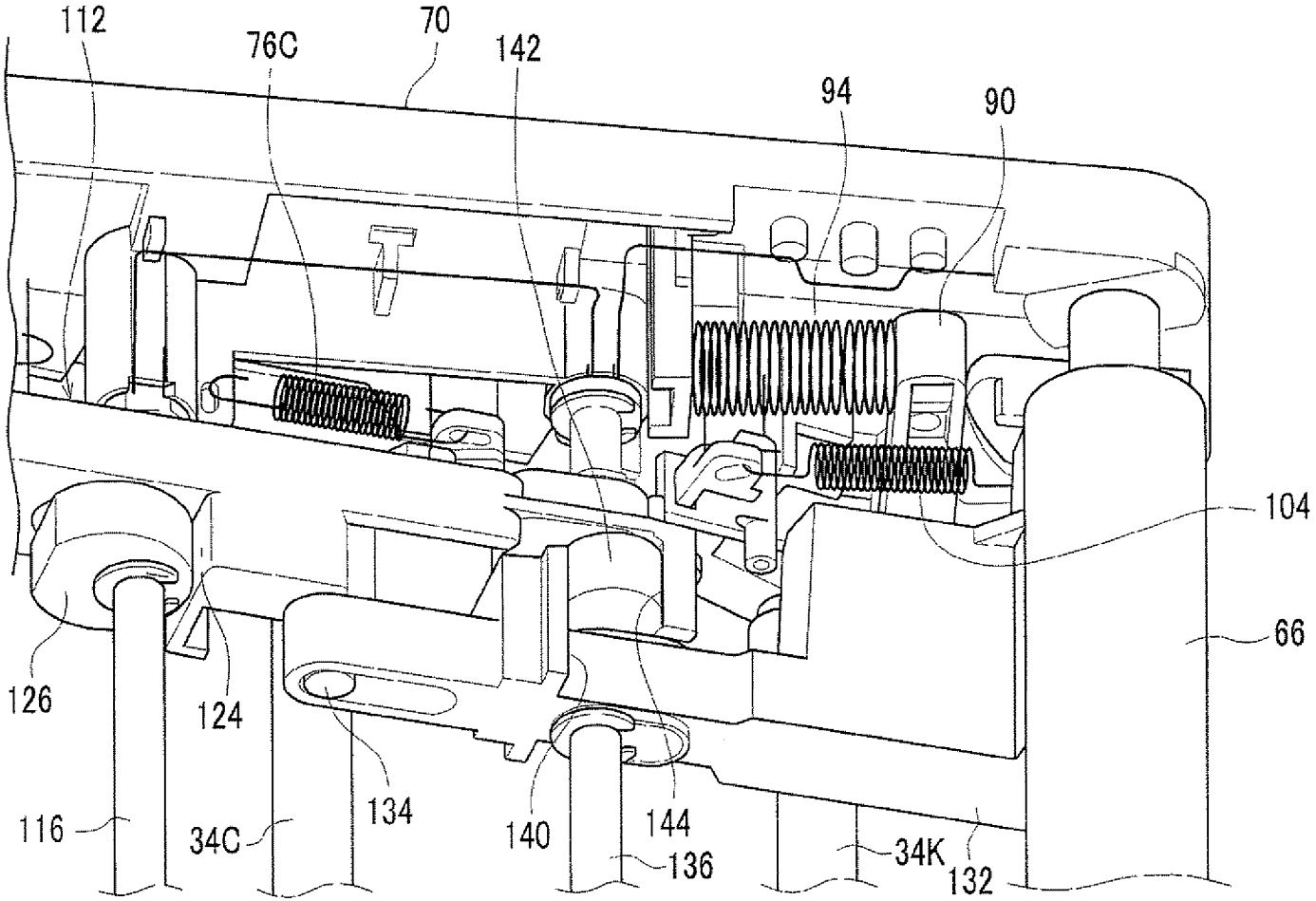
FIG. 11 is an enlarged perspective view illustrating the primary transfer unit according to the exemplary embodiment of the invention.

Specifically, as shown in FIGS. 3 and 11, the cam member 142 is disposed between the first moving member 112 and the second moving member 132 in the shaft direction. The cam member 142 is attached to the rod 136, and when the short-diameter portion of the cam member 142 faces the contact face 140, a pressing force is not transmitted to the support member 98 and the support member 90 via the protruding portion 146 and the protruding portion 138. The primary transfer roll 34K is located at the third position with the impelling force of the coil spring 104 and the tension roll 40 gives a tension to the intermediate transfer belt 32 with the impelling force of the coil spring 94.

Figure 12:
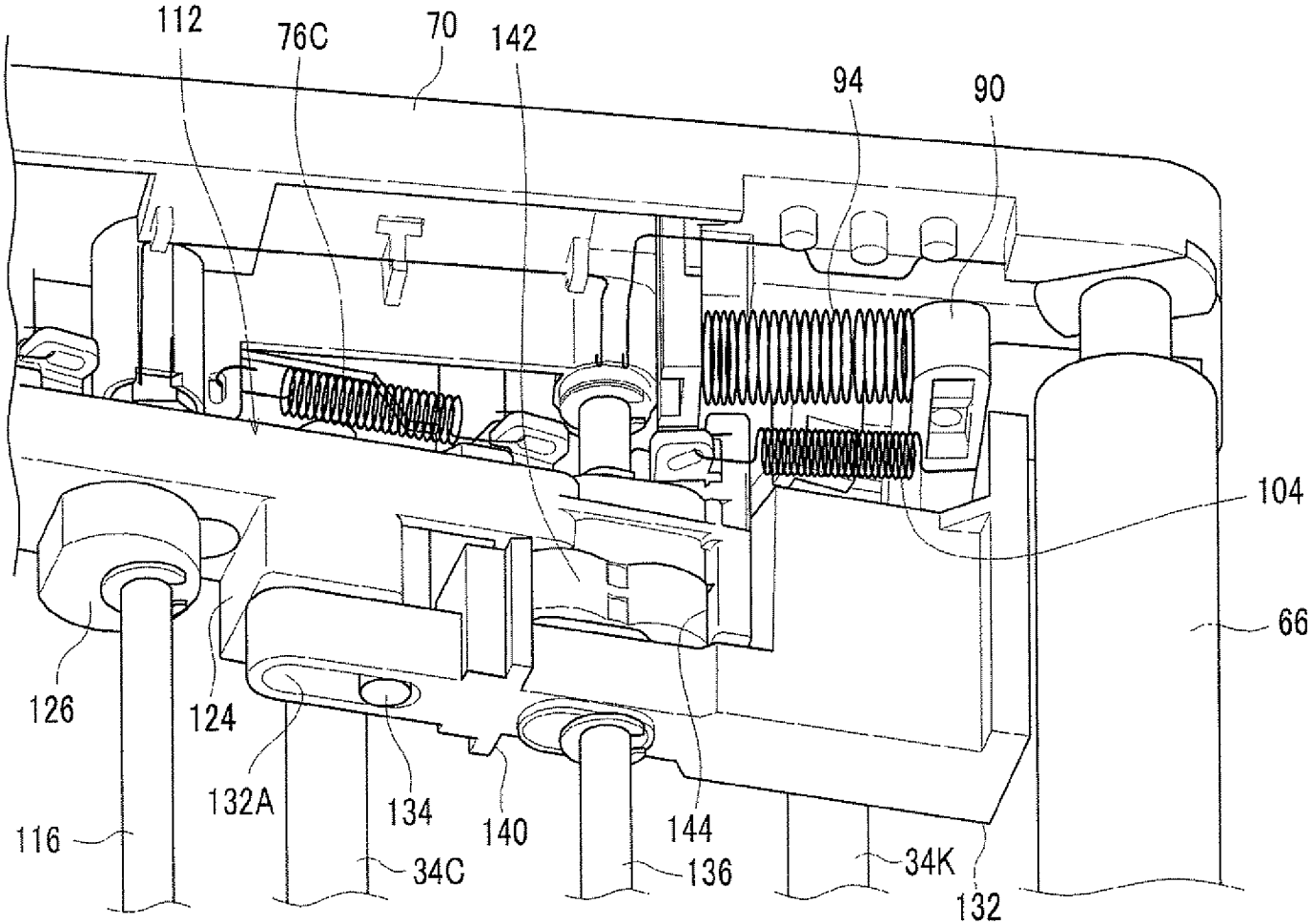
FIG. 12 is an enlarged perspective view illustrating the primary transfer unit according to the exemplary embodiment of the invention.

On the other hand, as shown in FIGS. 5 and 12, when the rod 136 rotates and the long-diameter portion of the cam member 142 comes in contact with the contact face 140, the contact face 140 is pressed by the cam member 126 and the second moving member 132 moves to the driving roll 36 in the first direction. When the second moving member 132 moves in the first direction, a pressing force is transmitted to the support member 98 and the support member 90 via the protruding portion 146 and the protruding portion 138. The support member 98 rotates about the rotation shaft 102 to locate the primary transfer roll 34K at the fourth position, and the support member 90 rotates about the rotation shaft 92 to release the tension given to the intermediate transfer belt 32.

Figure 6:
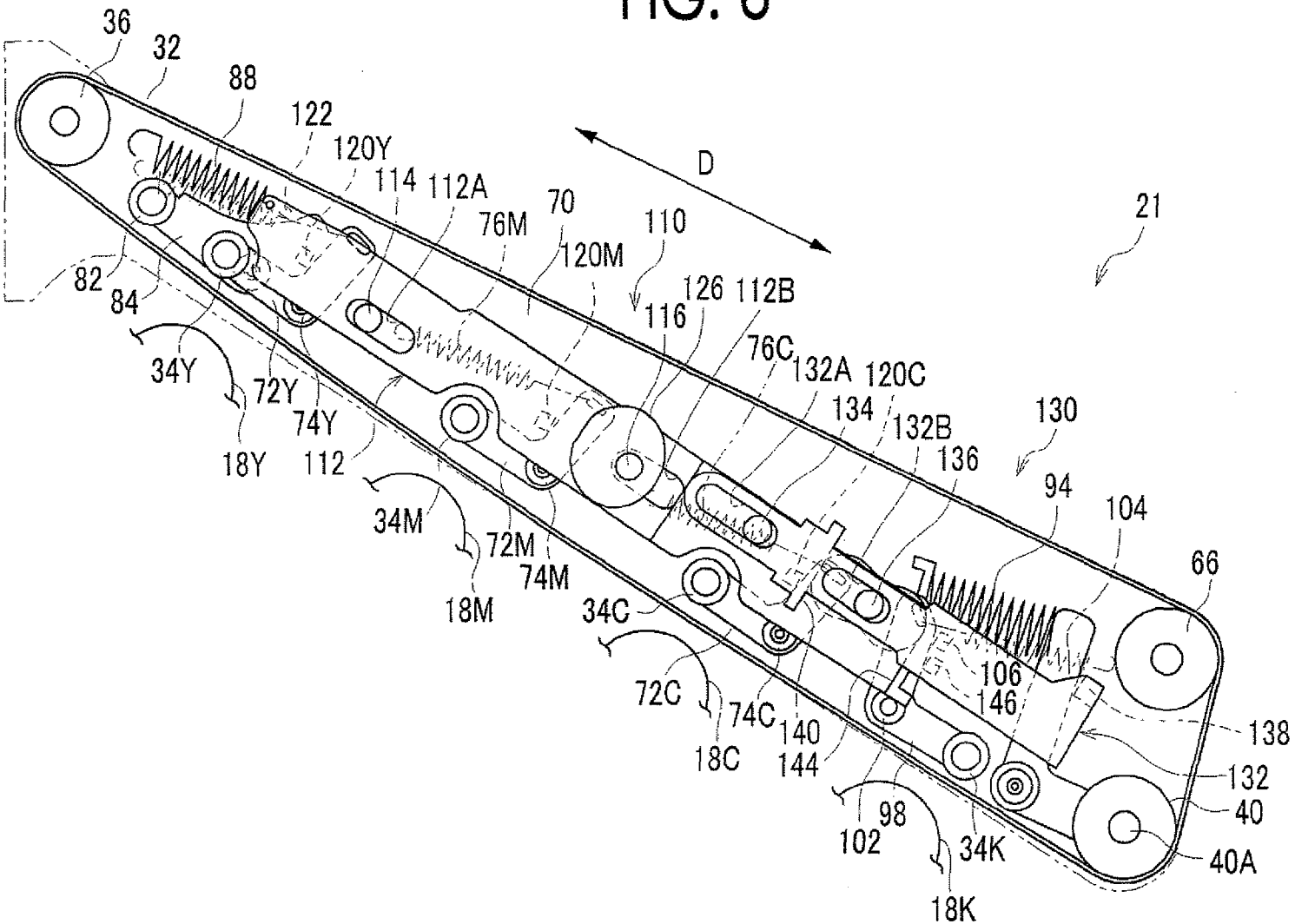
FIG. 6 is a side view illustrating the primary transfer unit according to the exemplary embodiment of the invention.

As shown in FIG. 3, a contact face 144 as an example of the third contact part disposed opposite to the contact face 140 with the cam member 142 interposed therebetween is formed in the first moving member 112 to face the driving roll 36. As shown in FIGS. 3 and 6, according to this configuration, when the rod 136 rotates to bring the long-diameter portion of the cam member 142 into contact with the contact face 144 in the state where the primary transfer rolls 34Y, 34M, and 34C are located at the first position, the regulation roll 82 and the primary transfer rolls 34Y, 34M, and 34C move from the first position (see FIG. 3) to the second position (see FIGS. 6 and 10).

As shown in FIG. 7, an engaging portion 148 allowing the attachment and detachment of a knob 158 (see FIG. 13) to be described later is disposed at an end of the rod 136 and a rotational force transmitted from the knob 158 is transmitted to the rod 136 via the engaging portion 148.

As shown in FIG. 4, in the state where the primary transfer rolls 34Y, 34M, and 34C are located at the second position and the primary transfer roll 34K is located at the third position, the cam member 142 is separated from the contact face 144. Accordingly, even when the cam member 142 rotates, the first moving member 112 does not move.

Figure 13:
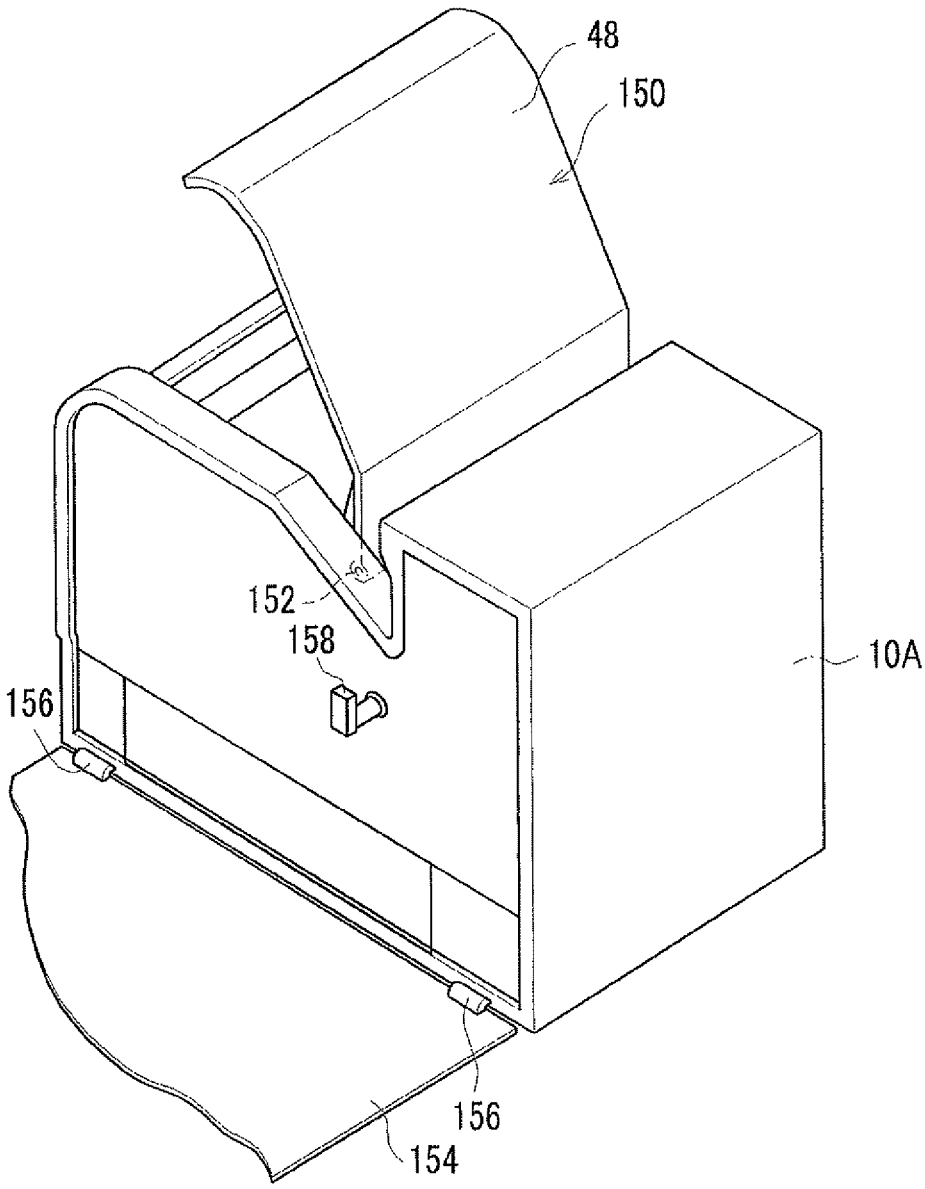
FIG. 13 is a perspective view illustrating an image forming apparatus according to the exemplary embodiment of the invention.

As shown in FIGS. 13 and 14, a cover member 150 that can open the inside and that has the discharge section 48 formed on the top is disposed in the upper part in the vertical direction of the apparatus body 10A. Specifically, a rotation shaft 152 extending in the depth direction (the depth direction from the drawing surface in FIG. 14) of the apparatus body 10A is disposed at an end of the cover member 150 and the inside of the apparatus body 10A is opened to the upside by causing the cover member 150 to rotate about the rotation shaft 152.

A cover member 154 opening the front surface of the apparatus body 10A is disposed on the front surface (the front surface in FIG. 14) of the apparatus body 10A. Specifically, a rotation shaft 156 extending in the width direction (in the right-left direction of the drawing surface in FIG. 14) of the apparatus body 10A is disposed at the lower end of the cover member 154 and the inside of the apparatus body 10A is opened to the front side by causing the cover member 154 to rotate about the rotation shaft 156.

The knob 158 that gives a rotational force via the engaging portion 148 (see FIG. 7) disposed at an end of the rod 136 and that can be attached to and detached from the engaging portion 148 is provided. The knob 158 is exposed to the outside by causing the cover member 154 to rotate and opening the inside of the apparatus body 10A to the front side.

Operation

The operation of the primary transfer unit will be described below.

As shown in FIGS. 1 and 3, in the multi-color transfer mode in which an image of plural colors is printed, the color primary transfer rolls 34 come in contact with the rear surface of the intermediate transfer belt 32.

That is, the regulation roll 82 and the primary transfer rolls 34Y, 34M, and 34C are set at the first position and the primary transfer roll 34K is set at the third position. A tension is given to the intermediate transfer belt 32 by the tension roll 40.

Here, by bringing the support member 98 into contact with the protruding portion 106 with the impelling force of the coil spring 104, the set position of the primary transfer roll 34K is determined.

Accordingly, between the regulation roll 82 and the primary transfer roll 34K of which the set position is determined, the moving positions of the intermediate transfer belt 32 passing through between the primary transfer rolls 34 and the image holding members 18 are regulated even when the tension roll 40 vibrates.

In this state, when a sheet member P to which toner images formed on the intermediate transfer belt 32 are transferred is transported to the primary transfer unit 21, the leading edge of the transported sheet member P comes in contact with the intermediate transfer belt 32 at the contact position T.

The transmission of the vibration of the intermediate transfer belt 32 generated by bringing the leading edge of the sheet member P into contact with the intermediate transfer belt 32 is suppressed because the primary transfer roll 34K of which the set position is determined is impelled with a strong impelling force.

On the other hand, the set positions of the primary transfer rolls 34Y, 34M, and 34C are determined by causing the impelling forces of the coil springs 76Y, 76M, and 76C to match the reaction force generated in the intermediate transfer belt 32 due to the impelling forces. That is, the pressing force (nip pressure) generated between the primary transfer rolls 34Y, 34M, and 34C and the intermediate transfer belt 32 is in the determined range.

As described above, by bringing the support member 98 into contact with the protruding portion 106 by the use of the impelling force of the coil spring 104 and thus determining the set position of the primary transfer roll 34K, the moving position of the intermediate transfer belt 32 passing through between the primary transfer rolls 34 and the image holding members 18 is regulated.

By determining the set position of the primary transfer roll 34K in this way, it is possible to reduce the number of dedicated members used to regulate the moving positions of the intermediate transfer belt 32 passing through between the primary transfer rolls 34 and the image holding members 18. For example, in the configuration according to the related art, dedicated members used to regulate the moving positions of the intermediate transfer belt are disposed more upstream in the circulating direction of the intermediate transfer belt than the Y primary transfer roll and more downstream in the circulating direction of the intermediate transfer belt than the K primary transfer roll. However, by employing the configuration according to this exemplary embodiment, the dedicated member disposed more downstream in the circulating direction of the intermediate transfer belt than the K primary transfer belt is saved.

Since the primary transfer roll 34K is formed of metal, it is possible to effectively suppress the transmission of the vibration generated by causing the sheet member P to come into contact with the intermediate transfer belt 32.

Although a specific exemplary embodiment of the invention has been described above in details, it will be apparent to those skilled in the art that the invention is not limited to the exemplary embodiment, but the invention may be modified in various forms without departing from the scope of the invention. For example, the set position of the primary transfer roll 34K is determined by bringing the support member 98 into contact with the protruding portion 106 by the use of the impelling force of the coil spring 104, but the set position of the primary transfer roll 34K may be determined by mechanically fixing the support member.

Although the exemplary embodiment of the invention is applied to the electrophotographic image forming apparatus, the image formation type is not limited to the electrophotographic type and the invention may be applied to other image forming apparatuses of an ink jet type and the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

an endless type member that is caused to circulate by a driving unit;

a plurality of transfer members (1) that come into contact with a rear surface of the endless member, (2) that are disposed opposite to a plurality of image holding members configured to hold toner images of different colors with the endless member interposed therebetween, respectively, and (3) that transfer the toner images respectively formed on the image holding members to the surface of the endless member;

a support member that movably supports a specific transfer member of the plurality of transfer members that is located at a position more upstream in a circulation direction of the endless member than a contact position and that is located closest to the contact position, the contact position being where a recording medium to which the toner images formed on the endless member are transferred by the transfer members comes into contact with the endless member;

a regulation member that regulates movement of the specific transfer member in a state in which the specific transfer member is disposed at a position where the toner image formed on the corresponding image holding member is transferred to the endless member;

a first impelling member that impels the support member to the regulation member; and a second impelling member that impels the transfer members other than the specific transfer member to the rear surface of the endless member, wherein set positions of the other transfer members are determined by causing an impelling force of the second impelling member to match a reaction force generated by the endless member due to the impelling force of the second member.

2. The transfer device according to claim 1, wherein a tension member that presses the endless member to give a tension to the endless member is disposed at a position of the endless member that is more upstream in the circulation direction than the contact position and more downstream in the circulation direction than the specific transfer member.

3. The transfer device according to claim 1, wherein the specific transfer member is a transfer roll that comes into contact with the rear surface of the circulating endless member and that rotates along with the circulating endless member, and wherein the transfer roll is formed of metal.

4. The transfer device according to claim 2, wherein the specific transfer member is a transfer roll that comes into contact with the rear surface of the circulating endless member and that rotates along with the circulating endless member, and wherein the transfer roll is formed of metal.

5. An image forming apparatus comprising:

the transfer device according to claim 1;

a plurality of image holding members that hold images on surfaces thereof and that are disposed opposite to the transfer members of the transfer device with the endless member of the transfer device interposed therebetween; and an image forming unit that forms the images on the image holding members.

* * * * *